United States Patent [19]

Kubota et al.

[11] 4,309,886

[45] Jan. 12, 1982

[54] PROCESS FOR PRODUCING STEEL STRIP MATERIAL FOR USE IN MANUFACTURE OF SHADOW MASK OF BRAUN TUBE FOR COLOR TV

[75] Inventors: Michio Kubota, Amagasaki; Takeshi Tsuda, Takatsuki; Masahiro Shimose; Kazuhiro Takagi, both of Amagasaki; Yasuo Imamura, Urawa; Kazunori Kato, Tokyo, all of Japan

[73] Assignees: Nisshin Steel Co., Ltd.; Dai Nippon Printing Co., Ltd., both of Tokyo, Japan

[21] Appl. No.: 83,634

[22] Filed: Oct. 11, 1979

[30] Foreign Application Priority Data

Oct. 18, 1978 [JP] Japan ..... 53-128030

[51] Int. Cl.[3] ..... B21B 1/00; B21B 3/02

[52] U.S. Cl. ..... 72/202; 29/163.5 R; 29/557; 72/364; 72/365; 72/700

[58] Field of Search ..... 29/557, 558, 163.5 R; 72/200, 202, 364, 700, 365; 148/11.5 R, 12 R, 12 A; 313/402

[56] References Cited

U.S. PATENT DOCUMENTS 3,909,928 10/1975 Sato et al. ..... 29/557

FOREIGN PATENT DOCUMENTS 49-110562 10/1974 Japan .

OTHER PUBLICATIONS

The Making Shaping and Treating of Steel, U.S Steel, 8th Edition, 1964, pp. 920, 921.

*Primary Examiner*—Ervin M. Combs

*Attorney, Agent, or Firm*—Kane, Dalsimer, Kane, Sullivan and Kurucz

[57] ABSTRACT

Low carbon steel strip is cold rolled with rolling reduction of 15 to 35% in final cold rolling step and annealed in form of tight coil at temperature of 520 to 600° C. to provide product having grain size number of 4 to 7 and coercive force of not greater than 2.0 Oersted as measured with initial magnetization field of 25 Oersted. The product is especially suitable for manufacturing shadow mask of Braun tube for color TV.

3 Claims, 4 Drawing Figures

PROCESS FOR PRODUCING STEEL STRIP MATERIAL FOR USE IN MANUFACTURE OF SHADOW MASK OF BRAUN TUBE FOR COLOR TV

BACKGROUND OF THE INVENTION

1. Field of the Invention

The present invention relates to a process for producing a steel strip material suitable for use in the manufacture of a shadow mask of a Braun tube for a color TV.

2. Brief Description of the Invention

As is well known a shadow mask is an extremely thin metal strip having a great number of small holes, which is to be mounted in advance of the fluorescent surface of a Braun tube for a color TV, and performs an important part in that three electron beams emitted from three electron guns in accordance with signals of the three primary colors are allowed to pass through each hole so that fluorescent dots distributed on the fluorescent surface are caused to luminesce in three separate colors. Such a shadow mask has heretofore been manufactured as follows. A steel maker subjects a strip of low carbon steel to a cold rolling finish with a rolling reduction of at least 40% to provide a strip material of not more than 0.2 mm in thickness, which is delivered in the form of coil to an etching processer. At the etching processer, the strip material is pretreated to remove oil while being unwound from the coil. Predetermined patterns of holes are then formed in the strip material by application of a photoresist on both sides of the strip, patternwise exposure of the photoresist, developing of the exposed photoresist, hardening of the developed photoresist by burning it at a temperature of about 200° C., etching of the material through the hardened patterned photoresist by spraying an aqueous ferric chloride, and removal of the photoresist. The product is cut into individual flat masks and delivered to a Braun tube maker. At the Braun tube maker, the flat mask having a predetermined pattern of holes is annealed to impart to it a sufficient ductility for the subsequent press-forming. This annealing is normally effected at a high temperature ranging between 750° and 900° C. with the individual masks suspended or stacked. Since the steel strip as annealed has a yield point elongation of several percent, "stretcher strains" (Lüders lines) arise when it is press-formed. Furthermore, the flat mask loses its evenness owing to the annealing. In order to erase the unevenness of the annealed strip and to prevent the stretcher strains, the annealed flat mask is passed several times through a roller leveller and thereafter press-formed into the desired curved plane. After the formation of oxide films on the surfaces, the shadow mask so manufactured is mounted in a Braun tube.

The prior art process stated above, in which the annealing step is carried out after the formation of holes, is referred to as a post-anneal process. The post-anneal process poses several problems, especially regarding the annealing step carried out by a Braun tube maker.

Since the flat masks are annealed while in the state of being suspended or stacked, the efficiency is low and the cost is expensive. The annealing temperature as high as 750° to 900° C. frequently results in the adhesion of flat masks, leading to the reduction in the yield. Even with successfully annealed flat masks, waves are formed by the annealing at high temperatures and the subsequent leveller rolling to erase such waves involves a danger in that the pattern of holes may be distorted or wrinkles may arise. Furthermore, the high temperature anneal causes the carbon in the low carbon steel material to diffuse and precipitate near the surfaces of the strip, and this precipitation of carbon is not necessarily uniform. Any non-uniformity of the carbon precipitation results in non-uniform elongation of the material in the press-forming step, and thus, faulty products are frequently found after the press-forming step.

To overcome the problems discussed above, attempts have been made to use lower annealing temperatures. However, when a sufficiently low annealing temperature for avoiding the adhesion and thermal distortion of flat masks was used, the grains became finer, resulting in an increase in the yield point elongation of the annealed material, and it was necessary to impractically increase the number of passes through a roller leveller for preventing stretcher stains.

For the purpose of avoiding the above-discussed problems inherent to the post-anneal process, processes, in which the annealing step is carried out before the hole formation, have been proposed. Such a process, in which the annealing step is carried out by a steel maker before the formation of holes, is referred to a pre-anneal process.

Japanese Patent Laid-Open Application No. 49-110,562, published on Oct. 21, 1974, discloses a process for producing a low carbon cold rolled steel strip for a shadow mask of a color Braun tube comprising cold rolling a hot rolled sheet of a low carbon and low manganese steel with a rolling reduction of at least 30%, annealing the cold rolled strip at a temperature of 650° to 750° C. and rolling the annealed strip for conditioning with a rolling reduction of 0.5 to 5.0%.

Japanese Patent Laid-Open Application No. 50-23317, published on Mar. 13, 1975, Japanese Patent Examined Publication No. 52-44868, and the corresponding U.S. Patent No. 3,909,928 issued on Oct. 7, 1975, disclose a method for manufacturing a shadow mask comprising annealing a low carbon sheet steel at a temperature of 550° to 650° C., subjecting the annealed sheet steel to skin-pass rolling for a reduction of 0.5 to 15% in thickness, forming holes in the sheet steel, and press-forming the sheet steel into a desired plane. It is taught in these specifications that the annealing step need be carried out to the extent that the crystal grain does not become large (larger than the ASTM grain size 7 or so).

The previously discussed problems inherent to the post-anneal process have been solved by the prior art pre-anneal process. We have found, however, that the problems have been solved at the sacrifice of a certain electromagnetic property of the product. By the post-anneal process it is possible to produce a product having a desirably low coercive force. By the "coercive force" of an ferromagnetic material is meant a strength of a magnetic field required to nullify any residual magnetic flux density which has remained after magnetization of the material to saturation by an external field and subsequent removal of such a magnetizing field. When a shadow mask mounted in a Braun tube for a color TV is magnetized, electron beams passing through the holes in the shadow mask are deflected and impact the fluorescent surface at undesired points ("mislanding"), resulting in color shading or deflection. To prevent such "mis-landing," a Braun tube is equipped with a degaussing circuit to erase the magnetization of the shadow mask. Because the degaussing circuit is very powerconsuming, a shadow mask having a low coercive force is desired. Generally, a shadow mask (before or after the press-forming) should preferably have a coercive force of not greater than about 2.0 Oersted when measured with the initial magnetizing field of 25 Oersted. By the prior art post-anneal process, the desired low level of the coercive force can be achieved, but this is not the case with the prior art pre-anneal process.

SUMMARY OF THE INVENTION

An object of the invention is to provide an improved pre-anneal process for manufacturing a shadow mask of a Braun tube for a color TV in which the annealing step is carried out by a steel maker prior to the formation of holes and the product of which has a low coercive force of not greater than 2.0 Oersted when measured with the initial magnetizing field of 25 Oersted.

This object can be achieved in accordance with the invention by utilizing a process for producing a steel strip material suitable for use in the manufacture of a shadow mask of a Braun tube for a color TV comprising the step of subjecting a strip of low carbon steel containing not more than 0.08% by weight of carbon to a cold rolling finish with a rolling reduction of 10 to 35% to provide a strip material of not more than 0.2 mm in thickness, and annealing the so rolled material in the form of a tight coil as wound up at a temperature of 520° to 600° C. for a period of at least 2 hours.

DETAILED DESCRIPTION OF THE INVENTION

The "grain size number" referred to herein was determined by the Method for Estimating Ferrite Grain Size of Steels in accordance with JIS G0552. Briefly speaking, the grain size number was determined depending upon the observed average number of grains per 25 mm square at a magnification of 100, using the key as shown in Table 1 below.

TABLE 1

| Grain Size Number | Average Number of Grains per 25 mm Square at 100× |
|---|---|
| −3 | 0.0625 |
| −2 | 0.125 |
| −1 | 0.25 |
| 0 | 0.5 |
| 1 | 1 |
| 2 | 2 |
| 3 | 4 |
| 4 | 8 |
| 5 | 16 |
| 6 | 32 |
| 7 | 64 |
| 8 | 128 |
| 9 | 256 |
| 10 | 512 |

Figure 4:
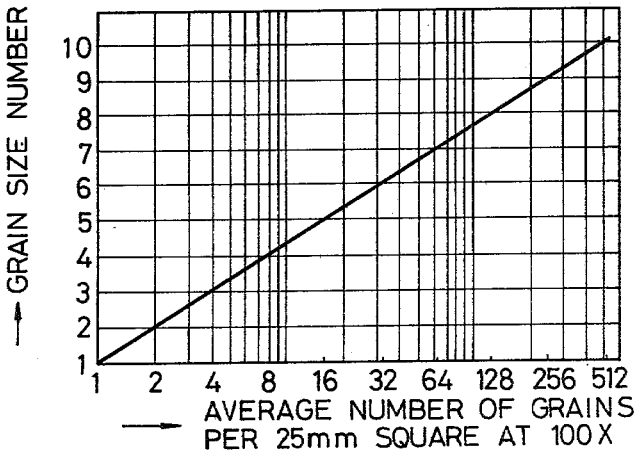
FIG. 4 is a graph for illustrating the grain size number.

This key is graphically shown in FIG. 4, in which the grain size number is plotted against the average number of grains per 25 mm square at a magnification of 100. Obviously, the greater the grain size number, the smaller the grains. For example, a grain size number of 4 means that there are 8 grains on average per 25 mm square at a magnification of 100, whereas a grain size number of 7 means that there are 64 grains on average per 25 mm square at a magnification of 100.

Figure 1:
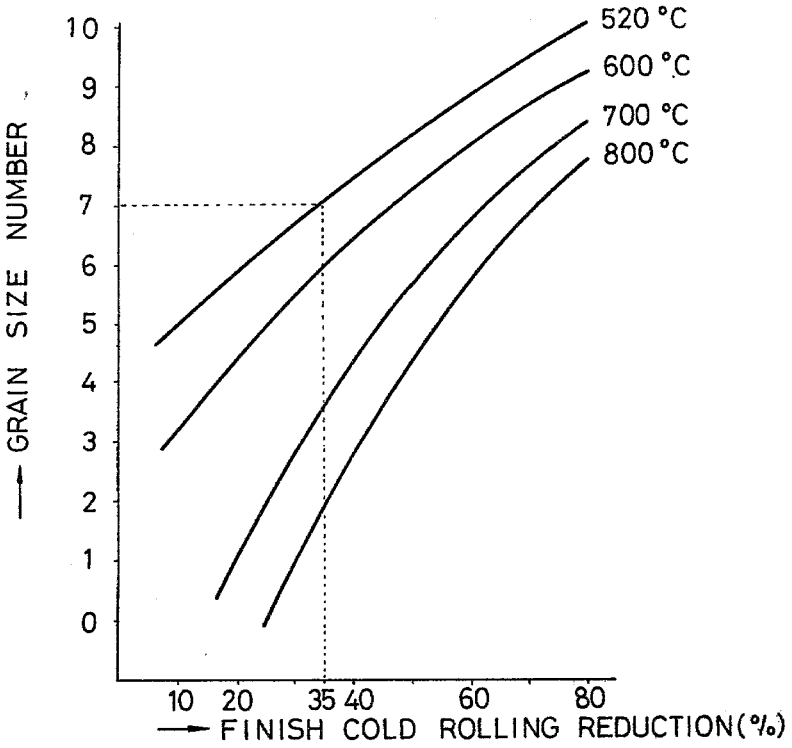
FIG. 1 is a graph illustrating the dependency of the grain size number upon the finish cold rolling reduction and the annealing temperature.

In a series of experiments strips of low-carbon steel containing 0.06% by weight of (C) were subjected to a cold rolling finish with various rolling reductions to provide strips of 0.15 mm in thickness and then annealed at various temperatures for 3 hours. For each annealing temperature tested the grain size number of the products was plotted against the finish rolling reduction. The curves so obtained are shown in FIG. 1. As seen from FIG. 1, a grain size number of 7 can be achieved under the conditions of a rolling reduction of 35%, which is the upper limit of the rolling reduction specified by the invention, and an annealing temperature of 520° C., which is the lower limit of the annealing temperature specified by the invention. FIG. 1 further reveals that as the finish cold rolling reduction becomes smaller than 35%, or as the annealing temperature becomes higher than 520° C., the grain size number becomes smaller, that is the grains become coarser.

Figure 2:
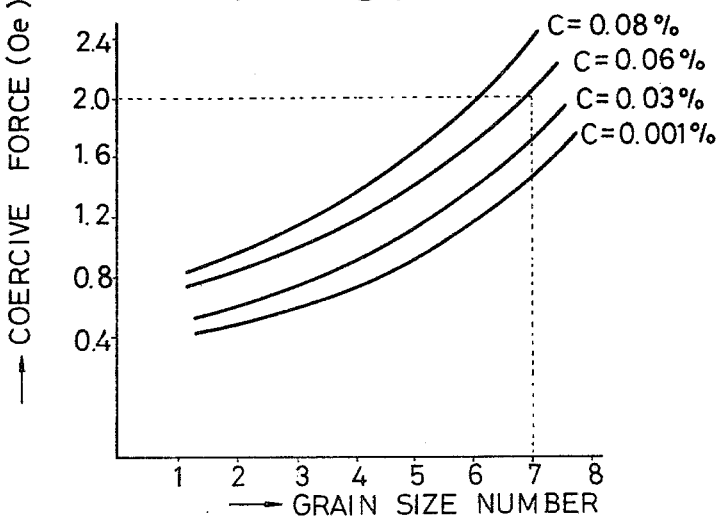
FIG. 2 is a graph illustrating the relation between the coercive force and the grain size number.

In another series of experiments, strips of low-carbon steel having various carbon contents were subjected to cold rolling finishes with various rolling reductions within the range of from 10 to 35% to provide strips of 0.15 mm in thickness and then annealed at a temperature of 600° C. for 3 hours. For each carbon content tested the coercive force of the products as measured using the initial magnetizing field of 25 Oersted, was plotted against the grain size number of the products. The curves so obtained are shown in FIG. 2. As seen from FIG. 2, most of the products having a grain size number of 7 or less exhibit the desired low coercive force of not greater than 2.0 Oersted as measured using the initial magnetizing field of 25 Oersted.

The results shown in FIGS. 1 and 2 reveal that in the manufacture of an extremely thin steel strip of 0.06% by weight carbon and 0.15 mm in thickness, a combination of a finish cold rolling with a rolling reduction of not more than 35% and an anneal at a temperature of at least 520° C. is critical for the production of a material having a grain size number of 7 or less and a coercive force of not greater than 2.0 Oersted. FIG. 2 further reveals that even with a steel of 0.08% carbon the desired low level of the coercive force may be achieved by the process conditions of the invention.

Figure 3:
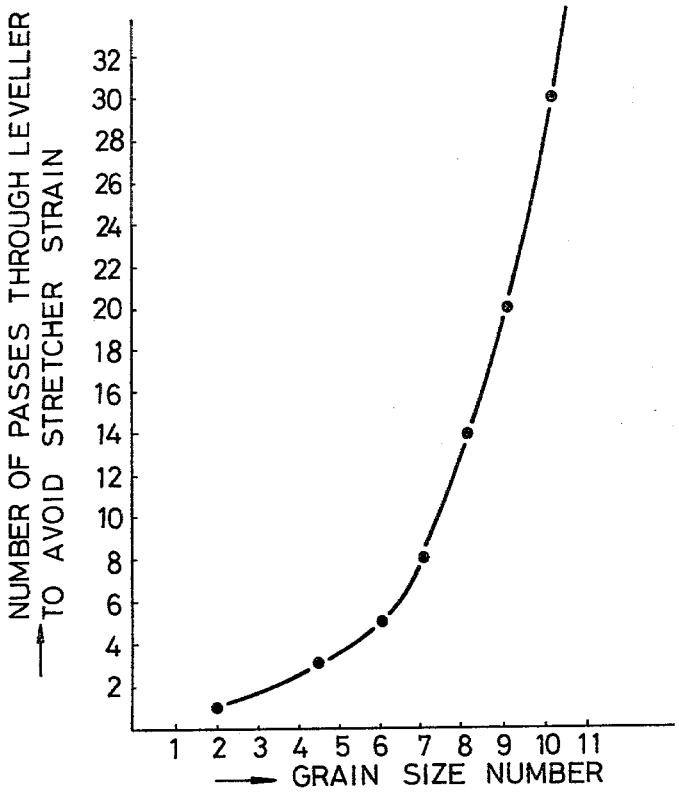
FIG. 3 is a graph showing the relation between the number of passes through a roller leveller required for avoiding "stretcher strains" and the grain size number.

Since a low rolling reduction of not more than 35% is used, the annealed strip material obtained by the process of the invention has coarse grains and exhibits a low yield point elongation. Accordingly, the number of passes through a roller leveller required for avoiding stretcher strains arising in the press-forming step can be small. The relation between the number of passes through a roller leveller required for avoiding stretcher strains and the grain size number of the strip is graphically shown in FIG. 3. FIG. 3 is based on the experiments in which steel strips of 0.06% carbon and 0.15 mm in thickness having various grain size numbers were prepared by varying the rolling reduction and annealing temperature, and tested using a standard roller leveller for a strip steel.

As revealed from FIG. 3, the greater the grain size number, that is the finer the grains, the greater the number of passes required. With fine grains, as intended in the prior art pre-anneal process, of a grain size number of more than 7, it is necessary to treat the flat mask by a roller leveller many times prior to the press-forming.

In the finish cold rolling step, the steel strip should be rolled with a rolling reduction of at least 10%, preferably at least 15%. If the rolling reduction is less than 10%, the number of nuclei for recrystallization formed in the course of the subsequent annealing step is unduly small, and depending upon the annealing conditions, no recrystallization occurs, or once it occurs, extremely coarse grains are formed. If the grains are coarser than those of a grain size number of 4, it is difficult to obtain a satisfactory product owing to the formation of coarse surface textures upon press-forming and to the lack of sufficient mechanical strength. Furthermore, coarse grains may be the cause of badly affecting the desired configuration of the inner walls of holes formed in the shadow mask. In general, plural grains should be present in the inner wall of one hole. If the grain size number is less than 4, grain boundaries of a monolithic single crystal might extend from one end of a hole to the other.

The annealing temperature should be not higher than 600° C., or otherwise adhesion of strip sections may occur because the strip is annealed in the form of a tight coil.

For the growth of the desired grain an annealing time of at least 2 hours is required. The upper limit of the annealing time is not critical. In general, the lower the annealing temperature the longer the annealing time will be required. However, the growth of grains becomes saturated after a certain period of time depending upon the conditions, an excessively prolonged annealing time is not necessary. Normally, an annealing time of 2 to 24 hours is practical.

The steel strip which has been processed in accordance with invention may be consequently subjected to a rolling for conditioning (skin-pass rolling). This conditioning rolling is carried out for the purposes of correction of shape, reduction in the yield point elongation and prevention of draping. It should be carried out with such a rolling reduction that the coercive force of the product is not adversely affected. Normally a reduction of 0.3 to 0.8% in thickness may be effected.

The steel strip material so produced is delivered to an etching processor, where predetermined patterns of holes are formed in the steel strip by a photoetching technique to provide a flat mask. In order to erase a yield point elongation, which has been recovered by burning during the course of hole formation, the flat mask is caused to pass several times through a roller leveller. This number of passes required is smaller for the products of the process according to the invention than for those obtainable by the prior art pre-anneal process, because the grains are coarser for the former products than the latter. The flat mask so levelled may then press-formed into the desired curved plane without the need of annealing which is required in the prior art post-anneal process.

While the description has been made about a low carbon steel, it should be appreciated that the invention is applicable to decarburized steel materials, including for example a cold rolled steel strip from a cold rolled steel sheet of an intermediate thickness which sheet has been subjected to decarburization in the form of an open coil in an atmosphere of wet hydrogen, a cold rolled steel strip prepared from a hot rolled steel sheet which has been subjected to decarburization in the form of an open coil in an atmosphere of wet hydrogen, and a cold rolled steel strip prepared from a hot rolled steel sheet from a steel which has been decarburized by a vacuum degassing process. The use of such decarburized steel materials is advantageous in that the annealing time may be shortened because the decarburization has rendered the materials to be in such a state that grains may readily grow in the course of annealing for recrystallization. Any species of low carbon steel, including rimmed, capped and killed steels, may be used in the process of the invention.

EXAMPLE

Coils of hot rolled steel sheets having a thickness of 2.5 mm were produced from a molten rimmed steel (C, 0.06%; Mn, 0.30%; Si, 0.01%; P, 0.017%; S, 0.013%) prepared in a 90 ton LD converter. Shadow masks of a thickness of 0.15 mm were manufactured by the processing procedures as indicated in Table 2, second column, for Run Nos. 1 to 6 and 8 to 13. The open coil decarburization anneal indicated in Table 2 as "OCDA" was carried out in a wet hydrogen atmosphere (AX gas having a dew point of +50° C.). In Run No. 7, a coil of a hot rolled steel sheet having a thickness of 2.5 mm was prepared from an alumi-killed steel (C, 0.005%; Si, 0.03%; Mn, 0.29%; P, 0.017%; S, 0.012%) which had been decarburized by a vacuum degassing process.

The ferrite grain size number measured prior to the press-forming step, coercive force (Hc) measured prior to the press-forming step using the initial magnetizing field of 25 Oersted, press-formability and number of passes through a standard roller leveller with a skin-pass reduction of 0.5% for one pass required to avoid stretcher strains occurring in the press-forming step were shown in Table 2 together with the processing conditions.

As seen from the results shown in Table 2, the products obtained by the process in accordance with the invention, in which the recrystallization anneal is carried in the form of a tight coil prior to the hole formation step, have a grain size number of 4 to 7 and a coercive force of not exceeding 2.0 Oersted, and exhibit good processing performance comparable or even superior to those of the product obtained in Run No. 5 which is a prior art post-anneal process in which the recrystallization anneal is carried out in the form of a flat mask after the hole formation step. Table 2 further reveals that the products of the process of the invention exhibits better electromagnetic property and processing performance than the product obtained in Run No. 9, which is a prior art pre-anneal process. If the finish cold rolling reduction is too high (Run No. 6), the product has a poor electromagnetic property as reflected by its high coercive force and requires a great number of passes through a roller leveller for avoiding stretcher strains. Whereas if the finish cold rolling reduction is too low (Run No. 13), the surface textures become coarse when the product is press-formed. If the annealing temperature is less than 520° C. (Run No. 11), no recrystallization takes place. Whereas if the annealing temperature substantially exceeds 600° C. (Run No. 12), the product is faulty in that adhesion of adjacent sections of a strip takes place.

Thus, it will be appreciated that the invention has made it possible to produce a shadow mask having a satisfactory electromagnetic property and a good processing performance by a pre-anneal process.

TABLE 2

| Run No. | Manufacturing Steps | C (%) | Finish cold rolling reduction | *Final anneal condition | Grain size number | Coercive force (Oe) | Press-formability | Number of passes through leveller to avoid stretcher strains | Remarks |
|---|---|---|---|---|---|---|---|---|---|
| 1 | HOT(2.5mm)→CP→CR (0.2mm)→TCA(570° C. × 8Hr)→CR(0.15mm) TCA*→SKP(1%)→Hole formation→leveller →press | 0.06 | 25% | 590° C. × 8Hr | 6.0 | 1.5 | Good | 5 | according to the invention |
| 2 | HOT(2.5mm)→CP→CR (0.18mm)→TCA(570° C. × 8Hr)→CR(0.15mm) →TCA*→SKP(1%)→ Hole formation→ leveller→press | 0.06 | 17% | 580° C. × 8Hr | 5.0 | 1.5 | Good | 4 | according to the invention |
| 3 | HOT(2.5mm)→CP→CR (0.6mm)→OCDA (690° C. × 12Hr)→CR(0.2mm)→ TCA(570° C. × 8Hr)→CR (0.15mm)→TCA*→ SKP(1%)→Hole formation→leveller→ press | 0.002 | 25% | 550° C. × 4Hr | 4.0 | 1.2 | Good | 3 | according to the invention |
| 4 | HOT(2.5mm)→CP→OCDA (690° C. × 12Hr)→CR (0.2mm)→TCA(570° C. × 8Hr)→CR(0.15mm) →TCA*→SKP(1%)→Hole formation→leveller →press | 0.002 | 25% | 550° C. × 4Hr | 4.0 | 1.2 | Good | 3 | according to the invention |
| 5 | HOT(2.5mm)→CP→CR (0.3mm)→TCA(570° C. × 8Hr)→CR(0.15mm)→Hole formation→post anneal (890° C. × 2Hr)→leveller→press | 0.05 | — | — | 6.0 | 1.4 | Good | 5 | prior art post-anneal process |
| 6 | HOT(2.5mm)→CP→CR (0.3mm)→TCA(570° C. × 8Hr)→CR(0.15mm) →TCA*→SKP(1%)→ Hole formation→ leveller→press | 0.06 | 50% | 570° C. × 8Hr | 10 | 4.5 | Good | 30 | rolling reduction is too high |
| 7 | Vacuum decarburization HOT(2.5mm) →CP→CR(0.2mm)→ TCA(550° C. × 8Hr)→ CR(0.15mm)→TCA*→ SKP(1%)→Hole formation→leveller→press | 0.005 | 25% | 550° C. × 8Hr | 4.5 | 1.3 | Good | 3 | according to the invention |
| 8 | HOT(2.5mm)→CP→ CR(0.23mm)→TCA (570° C. × 8Hr)→CR (0.15mm)→TCA*→ SKP(1%)→Hole formation→leveller→press | 0.05 | 34.8% | 600° C. × 10Hr | 6.5 | 1.8 | Good | 7 | according to the invention |
| 9 | HOT(2.5mm)→CP→CR (0.25mm)→TCA(620° C. × 8Hr)→CR(0.15mm)→ TCA*→SKP(1%)→Hole formation→leveller →press | 0.06 | 40% | 600° C. × 10Hr | 8.0 | 3.5 | Good | 14 | prior art pre-anneal process |
| 10 | HOT(2.5mm)→CP→CR (0.167mm)→TCA(570° C. × 8Hr)→CR(0.15mm)→ TCA*→SKP(1%)→Hole formation→leveller →press | 0.06 | 11.3% | 520° C. × 24Hr | 5.0 | 1.5 | Good | 4 | according to the invention |
| 11 | HOT(2.5mm)→CP→CR (0.20mm)→TCA(570° C. × 8Hr)→CR(0.15mm)→ TCA(*)→SKP(1%)→Hole formation→leveller →press | 0.06 | 25% | 500° C. × 24Hr | no recrystallization | 6.0 | Broken | — | annealing temperature is too low |

TABLE 2-continued

| Run No. | Manufacturing Steps | C (%) | Finish cold rolling reduction | *Final anneal condition | Grain size number | Coercive force (Oe) | Press-formability | Number of passes through leveller to avoid stretcher strains | Remarks |
|---|---|---|---|---|---|---|---|---|---|
| 12 | HOT(2.5mm)→CP→CR (0.20mm)→TCA(570° C. × 8Hr)→CR(0.15mm)→ TCA(*)→SKP(1%)→Hole formation→leveller →press | 0.06 | 25% | 620° C. × 10Hr | 5.0 | 1.5 | — | — | annealing temp. is too high. Adhesion of adjacent strip section |
| 13 | HOT(2.5mm)→CP→CR (0.163mm)→TCA(570° C. × 8Hr)→CR(0.15mm)→ TCA(*)→SKP(1%)→ Hole formation→ leveller→press | 0.06 | 8.7% | 550° C. × 15Hr | 3.0 | 1.2 | Good coarse surface textures | 2 | rolling reduction is too low |

HOT... Hot rolled sheet,
CP... Cold pickling
CR... Cold rolling
TCA... Tight coil anneal
OCDA... Open coil decarburization anneal
SKP... Skin-pass

What is claimed is:

1. A process for producing a strip of steel suitable for use in the manufacture of a shadow mask for the Braun tube of a color television receiver, which comprises:

providing a strip of low carbon steel having not more than 0.08 percent by weight of carbon;

subjecting the provided strip to a cold rolling reduction of 10 to 35 percent to obtain a finished strip of not more than 0.2 mm in thickness;

annealing the rolled strip, in the form of a tightly wound coil, at a temperature of from 520° to 600° C. for a period of at least 2 hours; and subjecting the annealed strip to conditioning by rolling until a reduction of 0.3 to 0.8 percent in thickness occurs;

whereby there is obtained a steel strip wherein the steel has a grain size number of 4 to 7 and a coercive force of not greater than 2.0 Oersted as measured with the initial magnetizing field of 25 Oersted.

2. A process in accordance with claim 1, wherein the finish cold rolling reduction is within the range between 15 and 35%.

3. A process in accordance with claim 1 wherein the starting steel strip contains not more than 0.06% by weight of carbon.

* * * * *